US007418936B2

(12) United States Patent
Diggs et al.

(10) Patent No.: US 7,418,936 B2
(45) Date of Patent: Sep. 2, 2008

(54) ENGINE AND VALVETRAIN WITH COMPACT ROCKER ARM AND FULCRUM ASSEMBLY FOR INTERNAL COMBUSTION ENGINES

(75) Inventors: Matthew Byrne Diggs, Farmington, MI (US); Jeff D Fluharty, Woodhaven, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 58 days.

(21) Appl. No.: 11/308,021

(22) Filed: Mar. 3, 2006

(65) Prior Publication Data

US 2007/0204826 A1 Sep. 6, 2007

(51) Int. Cl.
*F01L 1/18* (2006.01)

(52) U.S. Cl. ..... 123/90.39; 123/90.4; 123/90.41; 123/90.44; 29/888.2

(58) Field of Classification Search ..... 123/90.39, 123/90.41; 29/888.2
See application file for complete search history.

(56) References Cited

U.S. PATENT DOCUMENTS

| | | | | |
|---|---|---|---|---|
| 4,393,820 | A | 7/1983 | Maki et al. | |
| 4,476,822 | A | 10/1984 | Bonvallet | |
| 4,763,616 | A | 8/1988 | Grinsteiner | |
| 4,934,323 | A | 6/1990 | Grinsteiner | |
| 5,022,361 | A | 6/1991 | Schut | |
| 5,038,726 | A | 8/1991 | Pryba | |
| 5,560,265 | A | 10/1996 | Miller | |
| 5,617,818 | A | 4/1997 | Luders | |
| 5,657,726 | A | 8/1997 | Diggs | |
| 5,809,956 | A | 9/1998 | Regueiro | |
| 5,862,785 | A | 1/1999 | Blowers et al. | |
| 6,047,675 | A | 4/2000 | Kunz | |
| 6,273,042 | B1 | 8/2001 | Perez et al. | |
| 6,484,682 | B2 | 11/2002 | Danesh et al. | |
| 6,513,472 | B2 | 2/2003 | Speil et al. | |
| 6,659,056 | B2 | 12/2003 | Sweetland | |
| 6,830,022 | B2 * | 12/2004 | Lutz | 123/90.39 |
| 6,953,016 | B2 | 10/2005 | Karbstein et al. | |
| 6,962,134 | B1 | 11/2005 | Douse | |
| 2005/0056242 | A1 | 3/2005 | Murata et al. | |
| 2007/0044745 | A1 * | 3/2007 | Smith | 123/90.41 |
| 2007/0119397 | A1 * | 5/2007 | Diggs et al. | 123/90.4 |

* cited by examiner

*Primary Examiner*—Thomas Denion
*Assistant Examiner*—Kyle M Riddle
(74) *Attorney, Agent, or Firm*—Julia Voutyras; Bir Law, PLC; David S. Bir

(57) ABSTRACT

An internal combustion engine having a plurality of intake and/or exhaust valves associated with each cylinder includes a valvetrain having a fulcrum with a plurality of pivot ball sockets each associated with a rocker arm and pivot ball disposed between the fulcrum and the rocker arm with the fulcrum extending through apertures of the rocker arms and having a plurality of slots, each slot having generally parallel opposing lateral surfaces for receiving and guiding both sides of an associated rocker arm so the rocker arm pivots about the pivot ball in a plane of the rocker arm. The fulcrum can accommodate at least two rocker arms that may operate in non-parallel planes relative to one another and can include bearing and locating surfaces integrally formed to finish dimensions to eliminate machining.

17 Claims, 4 Drawing Sheets

ENGINE AND VALVETRAIN WITH COMPACT ROCKER ARM AND FULCRUM ASSEMBLY FOR INTERNAL COMBUSTION ENGINES

BACKGROUND OF THE INVENTION

1. Field of the Invention

The present invention relates to a compact rocker arm and fulcrum assembly for internal combustion engines having intake and/or exhaust poppet valves.

2. Background Art

Conventional internal combustion engines use a cams haft-driven valvetrain to operate intake and exhaust valves that control the exchange of gases in the combustion chambers formed between the engine block and cylinder head. Engines are often categorized by the location of the cams haft relative to the valves, with overhead cam valvetrains driven by a cams haft in the cylinder head over the valves, and pushrod valvetrains or "cam-in-block" valvetrains having the cams haft located in the engine block with the valves operated using pushrods and rocker arms.

Current four-valve-per-cylinder engines include two intake valves and two exhaust valves for each cylinder. As described in U.S. patent application Ser. No. 11/164,620 filed Nov. 30, 2005 and commonly owned by the assignee of the instant application, there are a number of advantages associated with having independent motion and lash adjustment for each valve rather than a bridged valvetrain implementation that actuates multiple valves in tandem. As such, a four-valve-per-cylinder application requires four independently pivotable rocker arms for each cylinder mounted in close proximity and properly aligned with the valve tips and pushrods (if present). Improper alignment may lead to uneven or side loading of the valves (and pushrods) with higher stresses resulting in higher rates of wear and potential noise, vibration, and harshness (NVH) concerns.

Relatively thin (or flat) rocker arms that pivot about a ball supported by a pedestal or fulcrum secured to the engine block have been developed as disclosed in U.S. Pat. Nos. 4,763,616 and 6,484,682, for example, and provide various advantages including reduced inertia relative to shaft-mounted rocker arms. Use of a ball/socket pivot arrangement requires that the rocker arm movement about two axes of rotation be limited or constrained so the rocker arm moves in a single plane about the third axis of rotation during operation. As such, these arrangements typically include one or more coplanar lateral or vertical surfaces on the pedestal or post to guide one side of each rocker arm so that it rotates or pivots in a single plane during operation to maintain desired alignment and loading. The pedestals or fulcrums also typically include one or more precision surfaces to provide for locating and aligning the rocker arms, valve tips, and pushrods relative to one another and the engine block, which increases cost and complexity of the assembly.

SUMMARY OF THE INVENTION

An internal combustion engine having a plurality of intake and/or exhaust valves associated with each cylinder includes a valvetrain having a fulcrum with a plurality of pivot ball sockets each associated with a rocker arm and pivot ball disposed between the fulcrum and the rocker arm with the fulcrum extending through apertures of the rocker arms and having a plurality of slots, each slot having generally parallel opposing lateral surfaces for receiving and guiding opposing faces of an aperture side wall of an associated rocker arm. The fulcrum can accommodate at least two rocker arms that may operate in non-parallel planes relative to one another and can include bearing and locating surfaces integrally formed to finish dimensions to eliminate machining.

A method for assembly of a rocker arm and fulcrum assembly for an engine having a plurality of intake and/or exhaust valves for each cylinder includes positioning an assembly plate having a generally flat base with a plurality of extensions corresponding to the number of rocker arms associated with a fulcrum by aligning holes in the base with corresponding holes in the fulcrum. A plurality of rocker arms having a central opening are positioned on the fulcrum by moving each rocker arm longitudinally along the fulcrum so the fulcrum and assembly plate pass through the central opening, aligning each rocker arm with a corresponding slot in the fulcrum, and moving the rocker arm in a generally transverse direction so opposing faces on one side of the central opening engage the corresponding slot in the fulcrum and a top wall of the central opening rests on a corresponding extension of the assembly plate. A pivot ball is held between a socket formed in the central opening of each rocker arm and a corresponding socket formed in the fulcrum by the assembly plate that captures the rocker arms above the fulcrum until the assembly is installed in a cylinder head where the valve tips and valve actuators engage opposite ends of the rocker arms and raise the tops of the central apertures above the assembly plate extensions or risers.

The present invention provides a number of advantages. For example, the present invention uses single-plane rocker arms with ball/socket pivots to provide a compact valvetrain that can accommodate four rocker arms on a single fulcrum to actuate four valves per cylinder. The fulcrum includes bumper or guide surfaces on opposite sides of each rocker arm to maintain proper alignment of the rocker arm and corresponding loading of valve tips during operation. The fulcrum may be formed of powdered metal with guide slots, pivot ball sockets and locating surfaces integrally formed of a unitary construction to finished dimensions so that subsequent machining of these surfaces is unnecessary. The rocker arms may include guide surfaces on both faces along at least one side wall of a central opening that are manufactured with a desired precision thickness where they engage the slots or bumpers. A fulcrum assembly according to the present invention can accommodate closely mounted pairs of non-parallel rocker arms so that a common lifter may actuate two or more intake valves or two or more exhaust valves with corresponding rocker arms that are substantially different in length, but have the same rocker ratio. The guide slots may be arranged so the long rocker arm and short rocker arm of each rocker arm pair engage a slot on opposite sides of the fulcrum to provide an efficient fulcrum structure that allows for placing two rocker arms close together with pivot ball supports and bumper slots. This arrangement also facilitates placing fulcrum fasteners on the outside of the rocker arm pairs to reduce any beam bending effect of the fulcrum during operation.

A valvetrain having a fulcrum according to the present invention facilitates positioning of rocker arms in non-parallel planes at close proximity. Use of a common fulcrum for all rocker arms associated with a particular cylinder improves alignment precision at multiple points within the valve gear because each point is precision located based on two dowel locators in the fulcrum that mount to the cylinder head. The fulcrum is designed for low cost and high precision using a powdered metal forming process with no machining required and provides multiple bearing surfaces which all have high precision relative to each other including pivot ball sockets, rocker arm guide or bumper surfaces, locating/mounting holes for dowel locators, and a mounting plane that couples to a cylinder head.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present invention as illustrated and described with reference to any one of the Figures may be combined with features illustrated in one or more other Figures to produce embodiments of the present invention that are not explicitly illustrated or described. The combinations of features illustrated provide representative embodiments for typical applications. However, various combinations and modifications of the features consistent with the teachings of the present invention may be desired for particular applications or implementations.

FIGS. 1-6 illustrate operation of an internal combustion engine and valvetrain according to a representative embodiment of the present invention. Multiple cylinder internal combustion engine 10 is generally of conventional design with the exception of various valvetrain components as described herein. As such, various conventional features associated with the engine and valvetrain are not explicitly illustrated or described. Those of ordinary skill in the art will recognize that the present invention may be used in various types and configurations of engines including but not limited to compression ignition and spark ignition engines arranged in a "V" configuration or an in-line configuration, for example. The representative embodiments illustrated to describe the invention include a four valve per cylinder compression ignition diesel engine. However, the present invention may be used in any applications having at least two gas exchange valves including applications having at least one intake valve and/or at least one exhaust valve. Similarly, the invention is particularly suited for use in engines having multiple valves controlled simultaneously by a single cams haft lobe and lifter due to its compact design, although the invention may also be used in applications where separate lifters are used to actuate each valve. While the present invention is illustrated in a cam-in-block engine configuration using pushrods to actuate the intake and exhaust valves (also referred to as a type-5 valvetrain), the invention may also be applied to applications where the rocker arms are directly actuated by a cams haft via a lifter (also referred to as a type-4 valvetrain). Those of ordinary skill in the art will recognize various other engine configurations in which a rocker arm assembly according to the present invention may be beneficial.

Figure 1:
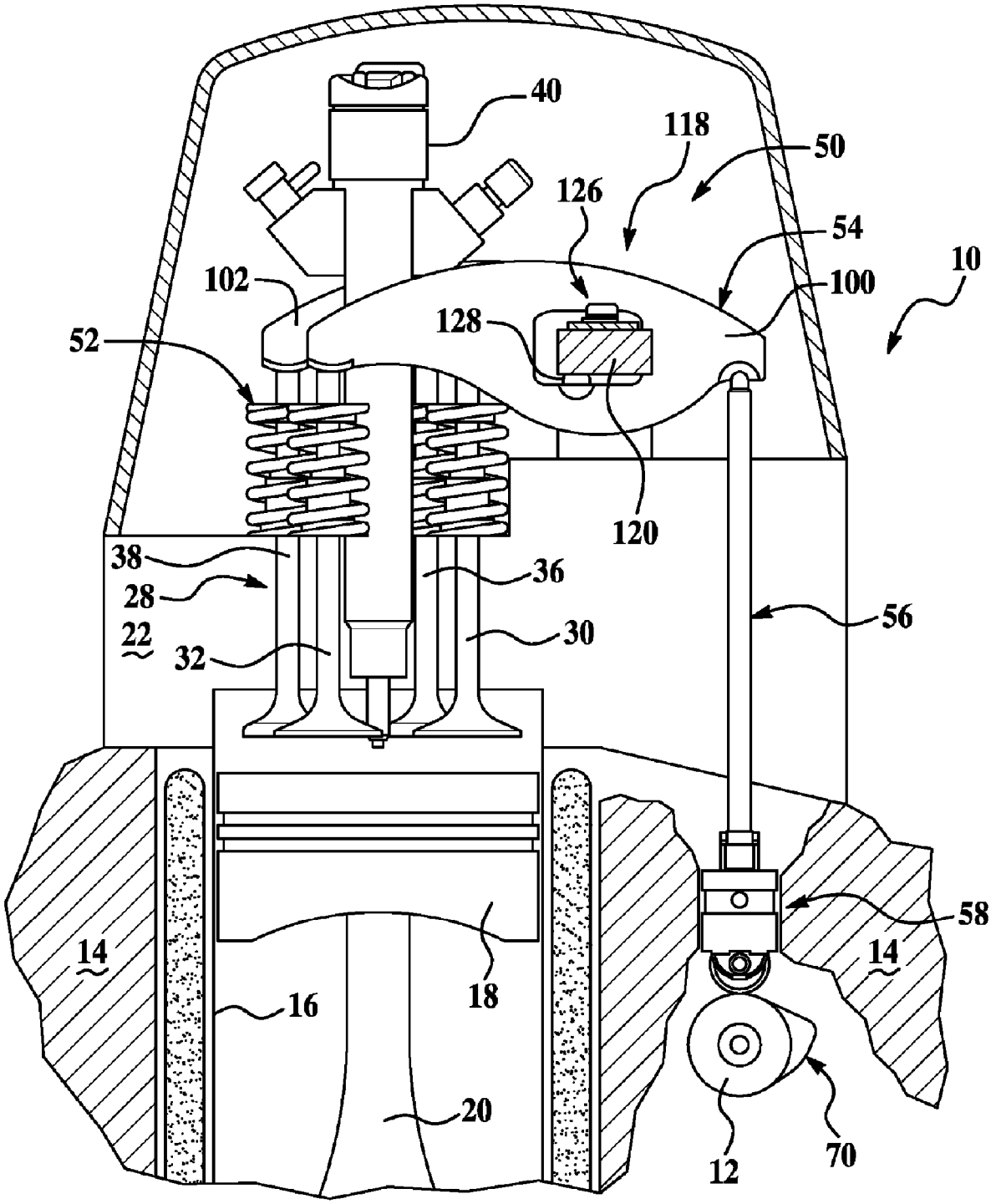
FIG. 1 illustrates a multi-cylinder internal combustion engine having a valvetrain with a rocker arm assembly according to one embodiment of the present invention.

As shown in the partial cut-away/cross-section of a representative application in FIG. 1, multiple cylinder internal combustion engine 10 includes a cams haft 12 disposed within an engine block 14, and may be referred to as a cam-in-block engine. Each cylinder 16 (only one of which is shown) includes a reciprocating piston 18 coupled by a connecting rod 20 to a crankshaft (not shown). Cylinder head 22 is secured to engine block 14 and provides conventional intake and exhaust passages (not shown) coupled to corresponding ports in cylinder head 22 (not shown) associated with gas exchange valves 28, which include intake valves 30, 32 and exhaust valves 36, 38. Cylinder head 22 includes conventional hardware such as valve guides, seats, etc. (not shown) associated with operation of gas exchange valves 28. A fuel injector 40 delivers fuel to cylinder 16 in response to a signal provided by an associated engine controller. Although a direct injection engine is illustrated in FIG. 1, the present invention may be used in engines having other fuel injection strategies, such as port injection, for example.

Engine 10 includes a valvetrain 50 to control intake of air and/or fuel (for port injected engines) into cylinder 16 and exhaust of combustion gases. Valvetrain 50 includes valves 28, valve springs 52, rocker arms 54, pushrods 56, and lifters 58, sometimes referred to as tappets or cam followers. Cams haft 12 includes lobes 70 to actuate valves 28. In one embodiment, cams haft 12 includes a single lobe to operate a pair of intake valves 30, 32 and another single lobe to operate a pair of associated exhaust valves 36 and 38. As such, each lifter 58 may include independently operable hydraulic lash adjusters to adjust lash associated with each of the pair of pushrods, rocker arms, and valves.

In operation, lifter 58 contacts lobe 70 of cams haft 12. As cams haft 12 rotates, lobe 70 raises lifter 58 and associated pushrods 56 that exert corresponding forces on associated rocker arms 100, 102. Each rocker arm 100, 102 pivots in a single plane about an integral ball/socket fulcrum 120 having bumpers or guide slots on opposite sides of each rocker arm according to the present invention as illustrated and described in greater detail with reference to FIGS. 2-6. Fulcrum 120 is secured to cylinder head 22 as known in the art. To facilitate installation of rocker arm assemblies 118 to cylinder head 22, an assembly plate 126 supports rocker arms 100, 102 above fulcrum 120 to maintain pivot balls 128 in corresponding sockets. As shown in FIG. 1, after installation to cylinder head 22, pushrods 56 and valves 28 support rocker arms 100, 102 so that there is no contact between assembly plate 126 and rocker arms 100, 102 during subsequent operation. Rocker arms 100, 102 translate the generally upward motion from pushrods 88, 90 to a generally downward motion to move valves 28 against associated springs 52 to open couple associated intake/exhaust ports to cylinder 16.

Figure 2:
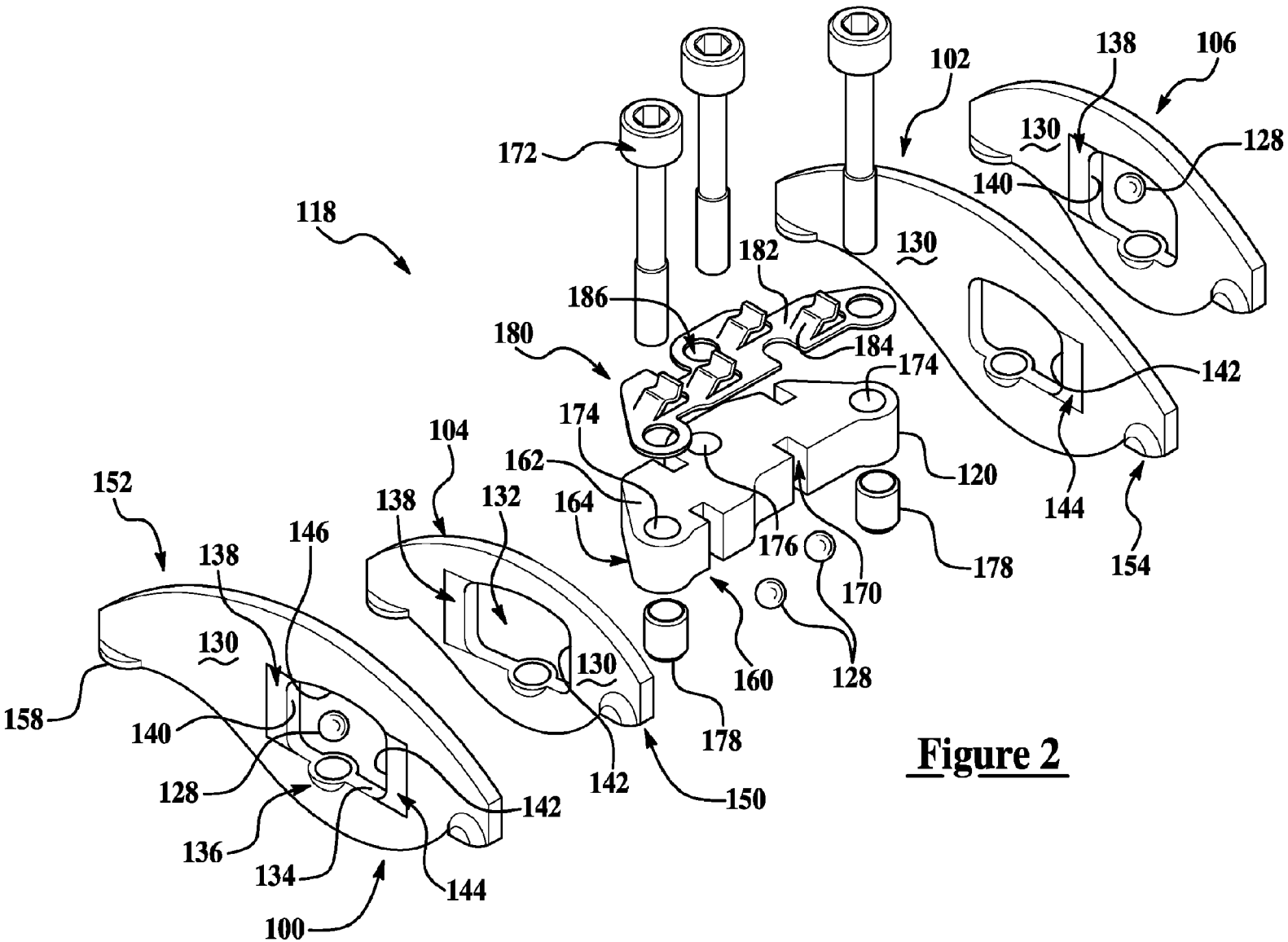
FIG. 2 is an assembly drawing illustrating a rocker arm assembly for a four-valve per cylinder internal combustion engine according to one embodiment of the present invention.
Figure 4:
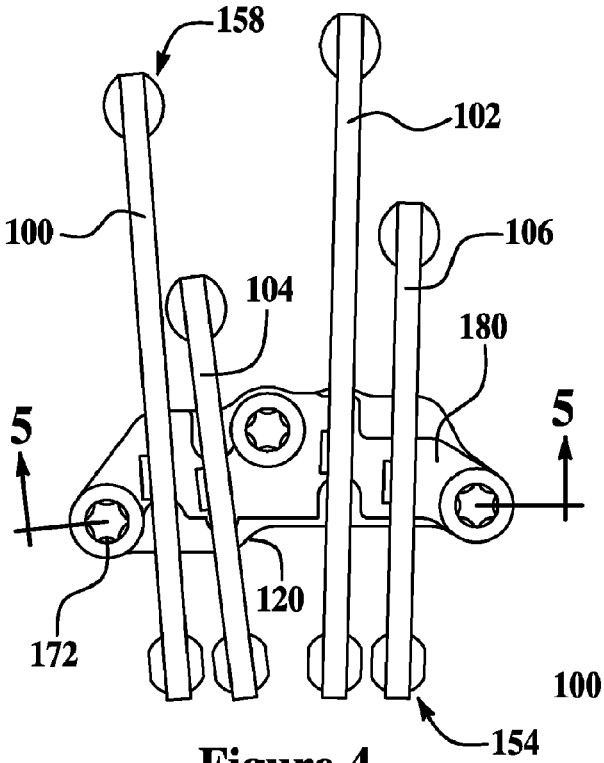
FIG. 4 is a top view of a rocker arm assembly according to one embodiment of the present invention.
Figure 5:
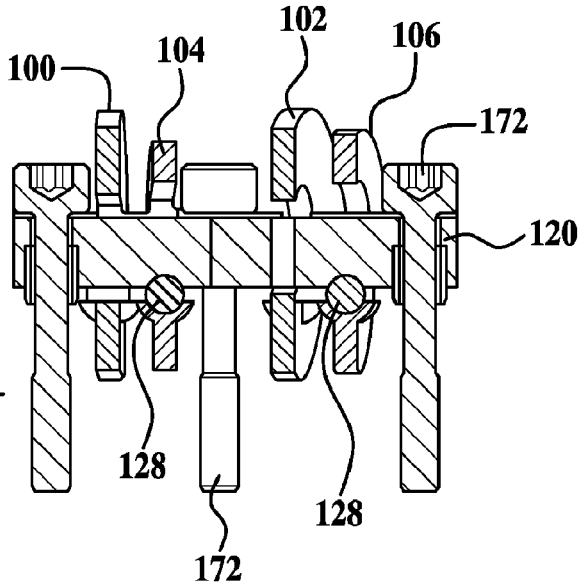
FIG. 5 is a cross-section taken along line 5-5 of the rocker arm assembly illustrated in FIG. 4.

FIG. 2 and the cross section of FIG. 5 (taken along line 5-5 in the top view of FIG. 4) illustrate a representative embodiment of a rocker arm assembly 118 according to the present invention. Rocker arms 100, 102, 104, and 106 have a one-piece body 130 with a central aperture or opening 132 defined by a bottom wall 134 having a structurally integral flared portion to create a socket 136 for engaging a pivot ball 128. Central aperture 132 is further defined by first and second side walls 140, 142 that may be referred to as an inboard side wall and an outboard side wall, respectively. Side walls 140, 142 extend from bottom wall 134 to a top wall 146. Each rocker arm 100, 102, 104, 106 uses a coplanar cold-formed or stamped steel construction with a narrow width profile to facilitate packaging for applications having multiple valves per cylinder. The width or thickness of the opposing surfaces 138 along side wall 140 and/or opposing surfaces 144 along side wall 142 may be precisely controlled within a region that engages a corresponding one of the guide slots 160 in fulcrum 120. Depending upon the particular manufacturing process used to form the rocker arms, and the particular application and implementation of the assembly, a rocker arm may include a precision controlled thickness area 138, 144 for opposing parallel surfaces along both side walls 140, 142, respectively, or may include opposing parallel surfaces with a precision thickness along only the side wall that engages a corresponding guide slot. For example, rocker arm 106 may include opposing precision surfaces 138 only along sidewall 140 where it engages a corresponding guide slot 160 of fulcrum 120, while rocker arm 102 may include opposing precision surfaces 144 only along sidewall 142 where it engages a corresponding guide slot.

Each rocker arm body 130 includes an actuator end 150 and a valve end 152. Actuator end 150 may include an integrally formed flared portion to create a socket 154 for cooperating with a ball-end pushrod. Alternatively, actuator end 150 may include a flat pad or other interface appropriate for a different style pushrod, or to be directly actuated by a cam follower, for example. Similarly, valve end 152 may include a flat valve pad 158 that cooperates with a corresponding valve tip. When assembly 118 is installed in a cylinder head, a flat pad 158 provides roll-axis (longitudinal axis) stability of the rocker arm via contact with a corresponding valve tip with the yaw axis (vertical axis) constrained by the generally parallel lateral (or vertical) surfaces of guide slots 160 so that each rocker arm pivots in a single plane (about the pitch axis of the rocker arm) about pivot ball 128. Depending upon the particular application, a pivot foot or elephant foot may be provided at valve end 158 to reduce stresses at the valve tip. Although a pivot foot or elephant foot interface does not provide roll-axis stability, the parallel lateral surfaces 170 of guide slots 160 engaging corresponding surfaces 138 or 144 of the rocker arms provides sufficient stability so that the rocker arms pivot in a single plane.

Figure 3:
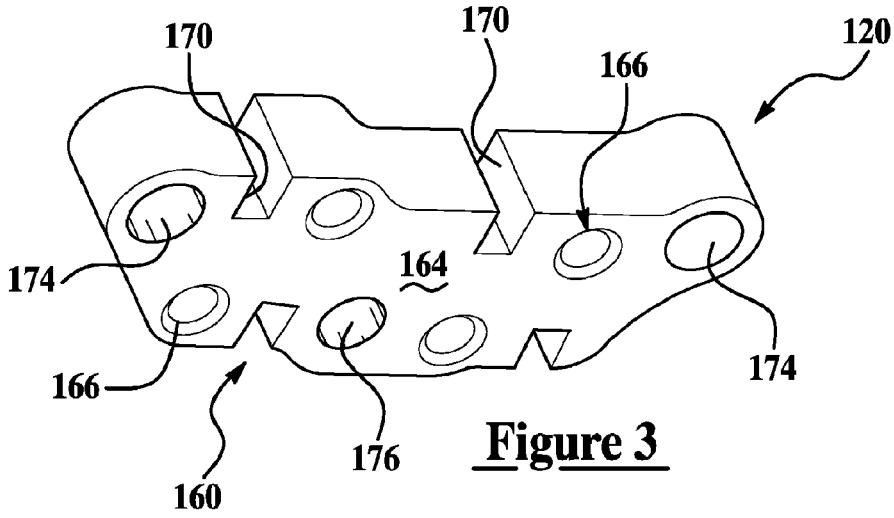
FIG. 3 is a perspective view from the bottom side of a fulcrum according to one embodiment of the present invention illustrating guide slots and pivot ball sockets.

As shown in FIGS. 2 and 3, fulcrum 120 includes a top surface 162 and a bottom mounting surface 164 having a plurality of pivot ball cups or sockets 166 each associated with one of the rocker arms for accommodating a pivot ball 128 disposed between fulcrum 120 and an associated rocker arm pivot ball cup or socket 136. Fulcrum 120 extends through central apertures 132 of each rocker arm with longitudinal positioning provided by a corresponding guide slot 160. A plurality of rocker arm guide slots 160 each include generally parallel lateral or vertical bumper or guide surfaces 170 that extend between top surface 162 and bottom mounting surface 164. Slots 160 extend from an outer periphery of fulcrum 120 toward a longitudinal center line with each slot preferably extending less than half way across. Slots 160 may be positioned in an alternating fashion extending from opposite inboard and outboard sides of fulcrum 120 to provide sufficient fulcrum strength to reduce beam bending effects. Different arrangements for guide slots 160 may be provided with adjacent slots extending from the same side of fulcrum 120 or all slots extending from the same side of fulcrum 120, for example, depending upon the particular application and implementation.

Fulcrum 120 has a plurality of through holes for receiving fasteners 172 that include two locating or alignment holes 174 for accurately positioning fulcrum 120 relative to cylinder head 22 and at least one additional fastening hole 176 for securing outboard side of fulcrum 120 to cylinder head 22. Hollow cylindrical dowel pins 178 are disposed partially within alignment holes 174 so pins 178 extend from bottom mounting surface 164 into corresponding locating holes of cylinder head 22 when installed. Use of hollow dowel pins 178 allows collocation of fasteners 172 that extend through pins 178 into the cylinder head to provide a compact assembly.

An assembly plate 180 is positioned on top surface 162 of fulcrum 120 and includes a generally flat base portion 182 and a plurality of risers or rocker arm supports 184, each associated with a corresponding rocker arm 100, 102, 104, 106. Each riser 184 extends from base portion 182 to support a top wall 146 of central opening 132 of a corresponding rocker arm. Risers 184 limit travel or movement of central openings 132 relative to fulcrum 120 during assembly to retain pivot balls 128 within corresponding sockets 136 and 166. When rocker arm assembly 118 is secured to cylinder head 122, rocker arms 100, 102, 104, 106 are supported by the valve pads 158 and push rod cups 154 against pivot balls 128 such that top wall 146 of central aperture 132 is positioned above risers 184 with sufficient clearance so that risers 184 do not contact the rocker arms during operation.

Assembly plate 180 may be formed of stamped steel or similar material with the material and/or construction of risers 184 selected to provide some resilience to facilitate temporary separation of sockets 136, 166 for insertion of a pivot ball 128, but exerting a sufficient force to return to a position that retains the pivot ball during subsequent handling of the assembly. Depending upon the particular method of assembly, risers 184 may be oriented to more easily slide the rocker arms over fulcrum 120 from either end. For example, in the embodiment illustrated in FIG. 2, all risers 184 are oriented to facilitate assembly of the rocker arms from one direction (left to right in the figure). Risers may be oriented to assemble some rocker arms from the left and others from the right, for example. Alternatively, risers 184 may extend in the direction of the rocker arms (generally transverse to the longitudinal axis of fulcrum 120) rather than in the longitudinal direction illustrated in FIG. 2.

Assembly plate 180 includes two or more locating features implemented by through holes 186 in the illustrated embodiment that align assembly plate 180 with corresponding through holes 174, 176 in fulcrum 120. Alignment is maintained by fasteners 172 that extend through assembly plate 180 and fulcrum 120. Other alignment tabs or similar features may be provided depending on the particular application.

The fulcrum design of the present invention facilitates forming using a powdered metal process with guide slots 160, bottom mounting surface 164, pivot ball sockets 166, and alignment holes 174 integrally formed of a unitary construction to finish dimensions to eliminate subsequent machining of these surfaces. Using a single piece fulcrum 120 for all rocker arms associated with a particular cylinder provides additional precision relative to common locating points provided by hollow dowel pins 178 collocated with fasteners 172 that secure fulcrum 120 to cylinder head 22. Improved precision may result in reduced noise, vibration, and harshness (NVH) and reduced wear during operation.

FIG. 2 also illustrates one embodiment of a method for assembling a mechanically actuated valvetrain for a multi-cylinder internal combustion engine. Those of ordinary skill in the art will recognize that various steps of the method may be performed in a different order than described here for illustrative purposes. Likewise, the assembly may be flipped or rotated for some or all of the steps to facilitate placement and retention of pivot balls 128 either in rocker arm sockets 136 or fulcrum sockets 166, which may impact the order of assembly operations. In this embodiment, hollow dowel pins 178 are inserted into corresponding alignment holes 174 of fulcrum 120 so that they extend from bottom surface 164. Assembly plate 180 is positioned on top surface 162 of fulcrum 120 by aligning holes 186 with corresponding holes 174, 176 in fulcrum 120. One or more fasteners 172 may be inserted through holes 174, 176 to maintain alignment of assembly plate 180 with fulcrum 120.

Assembly continues with rocker arms 100, 102, 104, 106 moving longitudinally along fulcrum 120 and assembly plate 180 with fulcrum 120 and assembly plate 180 passing through central openings 132. As previously described, all rocker arms may be assembled from the same direction or some from each direction depending upon the particular implementation. Each rocker arm is aligned with a corresponding slot 160 in fulcrum 120, which may be facilitated by risers 184, and subsequently moved in a generally transverse direction so one side wall 140, 142 of central opening 132 engages the corresponding slot 160 of fulcrum 120 and a top wall 146 of the central opening rests on a corresponding extension or riser 184 of assembly plate 180. In this embodiment, guide slots 160 are arranged in an alternating manner so that alternating rocker arms are moved in generally opposite transverse directions to engage a corresponding slot. For example, rocker arm 102 is moved in a first generally transverse direction to engage side wall 142, while rocker arm 106 is moved in a generally opposite transverse direction to engage side wall 140. Depending upon the particular application, risers 184 may also be used to secure each rocker arm in a transverse direction to remain engaged with a corresponding slot in addition to a longitudinal direction as illustrated. Alternatively, pivot balls 128 may be inserted in each rocker arm socket 136 or fulcrum socket 166 so that alignment of the rocker arms in the longitudinal and transverse directions is achieved when the pivot ball is positioned between corresponding rocker arm and fulcrum sockets.

Figure 6:
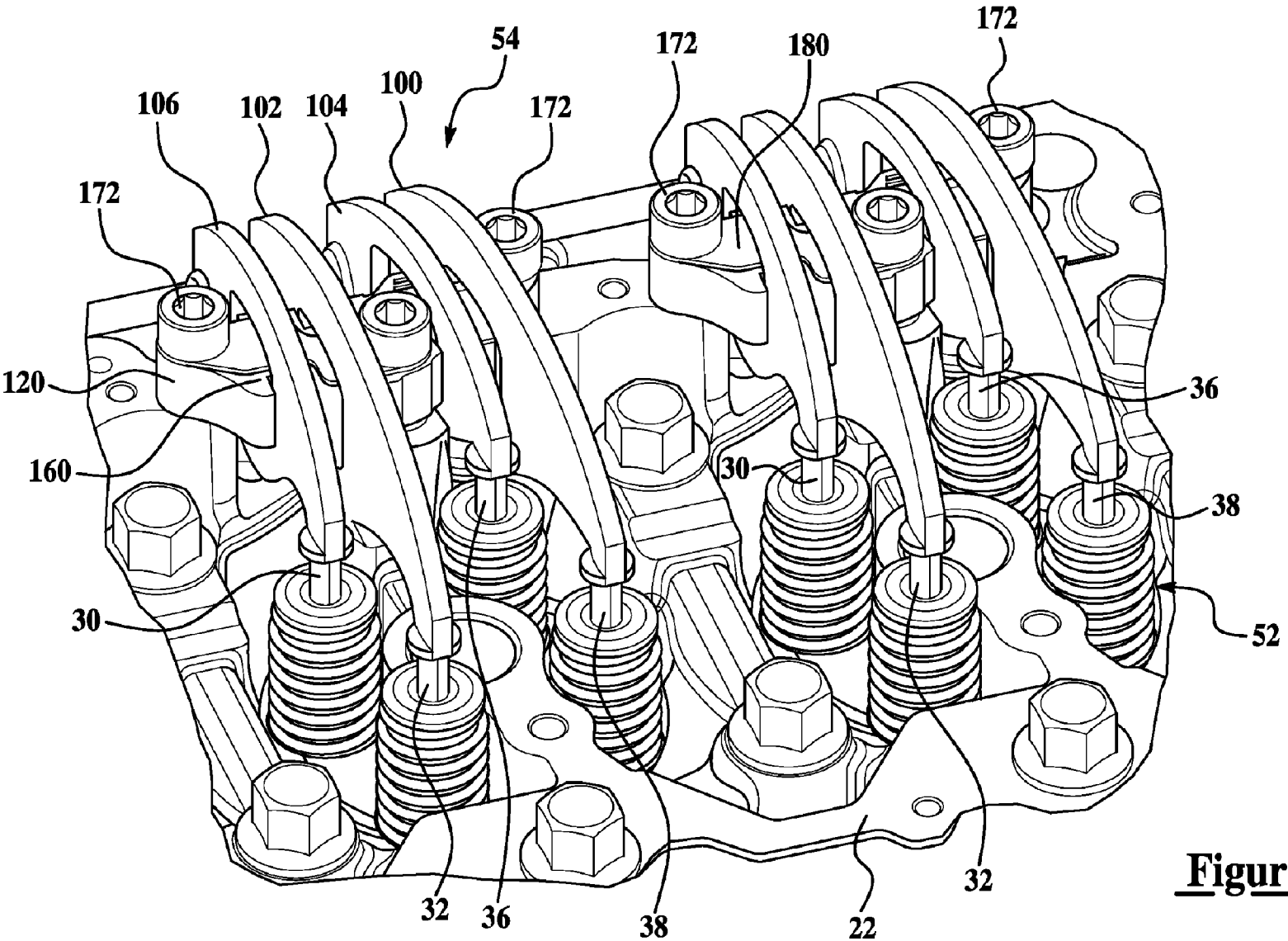
FIG. 6 is a perspective view of rocker arm assemblies according to the present invention installed in a cylinder head of an internal combustion engine.

FIG. 4 is a top view of rocker arm assembly 118 illustrating non-parallel or skew positioning of the rocker arms after being mounted to fulcrum 120 and held in position by assembly plate 180. As shown in FIGS. 4 and 6, valves may be positioned at different distances relative to corresponding pushrods and require substantially different lengths for associated rocker arms. In one embodiment of the present invention, rocker arm 102 is about 40% longer than rocker arm 104. However, use of a thin profile coplanar rocker arm with a ball/socket pivot according to the present invention allows appropriate positioning of the ball/socket on fulcrum 120 to provide substantially identical rocker ratios to produce substantially identical valve motion. For example, computer analysis indicates that valve lift profiles for pairs of valves in a representative valvetrain according to the present invention are within 0.025 millimeters (mm) of each other with rocker arm lengths that differ by about 40%. As known by those of ordinary skill in the art, the rocker ratio is generally understood to be the ratio of the distance between the pushrod and fulcrum relative to either the distance between the pushrod and valve stem, or the distance between the fulcrum and the valve stem. The rocker ratio may also be used to refer to the ratio of valve lift to cam lift.

As shown in FIGS. 4-6, fulcrum 120 provides a compact rocker arm assembly that can accommodate four-valve per cylinder applications with all rocker arms associated with a cylinder mounted on a common fulcrum. Rocker arms 100, 104 operate in non-parallel planes relative to one another and relative to rocker arms 102, 106. This facilitates use of the present invention in engine configurations having a "twisted" arrangement of intake/exhaust ports relative to the longitudinal axis of the engine.

As such, use of single-plane rocker arms with ball/socket pivots mounted on the same fulcrum according to the present invention provides a compact valvetrain that can accommodate four rocker arms to actuate four valves per cylinder. Incorporating rocker arm guide slots into the fulcrum to provide lateral or vertical guide surfaces on opposite sides of each rocker arm maintains proper alignment of the rocker arm and corresponding loading of valve tips during operation. The fulcrum design facilitates forming using a powdered metal process with guide slots, pivot ball sockets and locating surfaces integrally formed of a unitary construction to finished dimensions to eliminate subsequent machining of these surfaces and provide additional precision relative to common locating points provided by hollow dowel pins collocated with fasteners that secure the fulcrum to the cylinder head. The fulcrum can accommodate closely mounted, non-parallel rocker arms so that a common lifter may actuate two or more intake valves or two or more exhaust valves with corresponding rocker arms that are substantially different in length, but have the same rocker ratio. The guide slots may be arranged so the long rocker arm and short rocker arm of each rocker arm pair engage a slot on opposite sides of the fulcrum to provide an efficient fulcrum structure that allows for placing two rocker arms close together with pivot ball supports and bumper slots. This arrangement also facilitates positioning of fulcrum fasteners on the outside of the rocker arm pairs to reduce any beam bending effect of the fulcrum during operation.

While the best mode for carrying out the invention has been described in detail, those familiar with the art to which this invention relates will recognize various alternative designs and embodiments for practicing the invention as defined by the following claims.

What is claimed is:

1. An internal combustion engine having a plurality of intake and/or exhaust valves associated with each cylinder, the engine including a valvetrain comprising:

a plurality of independently pivotable rocker arms each associated with one of the plurality of valves, each rocker arm including an aperture defined by a bottom wall having a pivot ball cup and inboard and outboard side walls extending from the bottom wall to a top wall;

a single fulcrum associated with each cylinder and having a plurality of pivot ball cups each associated with one of the rocker arms for accommodating a pivot ball disposed between the fulcrum and an associated rocker arm pivot ball cup, the fulcrum extending through the apertures of the rocker arms and having at least four guide slots for receiving corresponding rocker arms for actuating at least two intake valves and at least two exhaust valves with each slot having generally parallel opposing lateral surfaces for receiving and guiding both sides of an associated rocker arm so the rocker arm pivots about the pivot ball in a plane of the rocker arm.

2. The engine of claim 1 wherein the fulcrum is formed of a unitary construction powdered metal material with guide slots integrally formed to a finish dimension.

3. The engine of claim 1 wherein the fulcrum includes a plurality of guide slots positioned in an alternating fashion to extend into inboard and outboard sides of the fulcrum to receive corresponding alternate inboard and outboard sides of adjacent rocker arms.

4. The engine of claim 1 wherein the fulcrum includes at least two non-parallel guide slots.

5. The engine of claim 1 wherein each fulcrum includes two alignment holes for locating the fulcrum relative to a cylinder head during assembly.

6. The engine of claim 5 further comprising:

a hollow cylindrical dowel pin partially disposed within each fulcrum alignment hole and extending into a corresponding alignment hole of the cylinder head, each dowel pin accommodating an attachment bolt for securing the fulcrum to the cylinder head.

7. An internal combustion engine having a plurality of intake and/or exhaust valves associated with each cylinder, the engine including a valvetrain comprising:

a plurality of independently pivotable rocker arms each associated with one of the plurality of valves, each rocker arm including an aperture defined by a bottom wall having a pivot ball cup and inboard and outboard side walls extending from the bottom wall to a top wall;

a fulcrum associated with each cylinder and having a plurality of pivot ball cups each associated with one of the rocker arms for accommodating a pivot ball disposed between the fulcrum and an associated rocker arm pivot ball cup, the fulcrum extending through the apertures of the rocker arms and having a plurality of guide slots for receiving corresponding rocker arms with each slot having generally parallel opposing lateral surfaces for receiving and guiding both sides of an associated rocker arm so the rocker arm pivots about the pivot ball in a plane of the rocker arm; and an assembly plate associated with each fulcrum, each assembly plate having a plurality of risers, one for each rocker arm, each riser extending between the plate and the top wall of the aperture of an associated rocker arm to separate the fulcrum from the top wall of the aperture a sufficient distance to retain a pivot ball within an associated ball cup of the fulcrum and ball cup in the bottom wall of the rocker arm during assembly.

8. The engine of claim 7 wherein valve tips of the intake and exhaust valves raise the top walls of corresponding rocker arms above corresponding risers when the fulcrum is installed in the engine to provide clearance between the riser and the aperture top wall during operation of the engine.

9. A rocker arm assembly for installation in a cylinder head of an internal combustion engine having a plurality of gas exchange valves associated with each cylinder, the rocker arm assembly comprising:

a plurality of rocker arms each associated with one of the gas exchange valves, each rocker arm including a central opening defined by a bottom wall having a pivot ball socket formed therein and first and second side walls extending from the bottom wall to a top wall;

a single fulcrum for each cylinder having a bottom surface with a pivot ball socket formed therein corresponding to each of the rocker arms, the fulcrum generally extending through the central opening of each rocker arm and having a slot with lateral surfaces extending along opposing surfaces of each rocker arm along at least one of the first and second side walls and including at least two through holes for securing the fulcrum to a cylinder head;

two hollow locating pins each partially disposed within a fulcrum through hole and extending from the fulcrum bottom surface for engaging corresponding locating holes in the cylinder head and accommodating associated fasteners extending through the hollow locating pin:

a pivot ball disposed between each fulcrum socket and corresponding rocker arm socket;

an assembly plate having a base for resting on a top surface of the fulcrum and a plurality of rocker arm supports, one for each rocker arm that extends from the base and engages the top wall of a corresponding rocker arm central opening to limit movement between the pivot ball sockets of the rocker arm and bottom surface of the fulcrum to retain the pivot ball in the sockets during assembly.

10. The rocker arm assembly of claim 9 wherein the assembly plate includes at least two holes corresponding to at least two through holes of the fulcrum to position the plate relative to the fulcrum.

11. The rocker arm assembly of claim 9 wherein the fulcrum is constructed of powdered metal with pivot ball sockets and rocker arm slots integrally formed to finish dimensions without machining.

12. The rocker arm assembly of claim 9 wherein alternate fulcrum slots extend into the fulcrum from only generally opposite alternating sides of the fulcrum.

13. The rocker arm assembly of claim 9 wherein the fulcrum slots extend less than halfway across the fulcrum.

14. A rocker arm assembly for installation in a cylinder head of an internal combustion engine having a plurality of gas exchange valves associated with each cylinder, the rocker arm assembly comprising:

a plurality of rocker arms each associated with one of the gas exchange valves, each rocker arm including a central opening defined by a bottom wall having a pivot ball socket formed therein and first and second side walls extending from the bottom wall to a top wall;

a fulcrum having a bottom surface with a pivot ball socket formed therein corresponding to each of the rocker arms, the fulcrum generally extending through the central opening of each rocker arm and having a slot with lateral surfaces extending along opposing surfaces of each rocker arm along at least one of the first and second side walls;

a pivot ball disposed between each fulcrum socket and corresponding rocker arm socket;

an assembly plate having a base for resting on a top surface of the fulcrum and a plurality of rocker arm supports, one for each rocker arm that extends from the base and engages the top wall of a corresponding rocker arm central opening to limit movement between the pivot ball sockets of the rocker arm and bottom surface of the fulcrum to retain the pivot ball in the sockets during assembly, wherein the assembly plate includes resilient rocker arm supports to allow temporary separation of corresponding pivot ball sockets of the fulcrum and rocker arm for installation of a pivot ball in the sockets.

15. A method for assembling a valvetrain for an internal combustion engine having a plurality of intake and/or exhaust valves for each cylinder, the method comprising:

positioning an assembly plate having a generally flat base with a plurality of resilient extensions corresponding to a number of valves per cylinder for the engine on a fulcrum;

positioning rocker arms having a central opening on the fulcrum by moving each rocker arm longitudinally along the fulcrum so the fulcrum and assembly plate pass through the central opening, aligning each rocker arm with a corresponding slot in the fulcrum, and moving the rocker arm in a generally transverse direction so one wall of the central opening engages the corresponding slot in the fulcrum and a top wall of the central opening rests on a corresponding extension of the assembly plate; and inserting a pivot ball in one of a socket formed in the central opening of each rocker arm and a corresponding socket formed in the fulcrum such that the pivot ball is retained between corresponding sockets in the rocker arm and fulcrum after positioning the rocker arms on the fulcrum;

wherein alternate rocker arms are moved in generally opposite transverse directions after being longitudinally positioned on the fulcrum to engage corresponding slots positioned in an alternating manner on generally opposite sides of the fulcrum.

16. The method of claim 15 further comprising:

inserting fasteners through the holes in the base of the assembly plate and the fulcrum to maintain alignment of the assembly plate and fulcrum and to provide subsequent fastening of the assembly to a cylinder head.

17. A method for assembling a valvetrain for an internal combustion engine having a plurality of intake and/or exhaust valves for each cylinder, the method comprising:

positioning an assembly plate having a generally flat base with a plurality of resilient extensions corresponding to a number of valves per cylinder for the engine on a fulcrum;

positioning rocker arms having a central opening on the fulcrum by moving each rocker arm longitudinally along the fulcrum so the fulcrum and assembly plate pass through the central opening, aligning each rocker arm with a corresponding slot in the fulcrum, and moving the rocker arm in a generally transverse direction so one wall of the central opening engages the corresponding slot in the fulcrum and a ton wall of the central opening rests on a corresponding extension of the assembly plate; and inserting a pivot ball in one of a socket formed in the central opening of each rocker arm and a corresponding socket formed in the fulcrum such that the pivot ball is retained between corresponding sockets in the rocker arm and fulcrum after positioning the rocker arms on the fulcrum;

wherein positioning rocker arms comprises positioning four rocker arms on each fulcrum with two rocker arms being moved in a first longitudinal direction toward a center of the fulcrum and two rocker arms being moved in an opposite longitudinal direction toward the center of the fulcrum.

* * * * *